United States Patent [19]

Kehoe

[11] Patent Number: 4,582,345

[45] Date of Patent: Apr. 15, 1986

[54] SECURITY DEVICE FOR SHEET MATERIAL AND METHOD OF MARKING THE DEVICE

[76] Inventor: Terrence F. Kehoe, 8 Seaview Ave., Milford, Conn. 06460

[21] Appl. No.: 608,769

[22] Filed: May 10, 1984

[51] Int. Cl.[4] ..... B42D 15/00

[52] U.S. Cl. ..... 283/70; 283/57

[58] Field of Search ..... 283/58, 70, 73

[56] References Cited

U.S. PATENT DOCUMENTS

| | | | |
|---|---|---|---|
| 852,257 | 4/1907 | Collier | 283/73 |
| 1,344,235 | 6/1920 | Kopecky | 283/73 |
| 1,465,099 | 8/1923 | Stolberg | 283/73 |
| 1,567,613 | 12/1925 | Patton, Jr. | 283/73 X |
| 4,358,852 | 11/1982 | Ichikawa et al. | 283/73 X |

*Primary Examiner*—Paul A. Bell

*Attorney, Agent, or Firm*—Bachman & LaPointe

[57] ABSTRACT

A method of indicating the face value of a commercial document such as a bank draft or a check while simultaneously precluding subsequent alteration thereof.

1 Claim, 3 Drawing Figures

| | | | | | | | |
|---|---|---|---|---|---|---|---|
| ■ | A | B | C | 1 | 2 | 3 | EIGHTH SYMBOL |
| ■ | A | B | C | 1 | 2 | 3 | SEVENTH SYMBOL |
| 0 | A | B | C | 1 | 2 | ■ | SIXTH SYMBOL |
| 0 | A | B | C | 1 | 2 | ■ | FIFTH SYMBOL |
| 0 | A | B | C | 1 | 2 | ■ | FOURTH SYMBOL |
| 0 | A | ■ | C | 1 | 2 | 3 | THIRD SYMBOL |
| 0 | ■ | B | C | 1 | 2 | 3 | SECOND SYMBOL |
| 0 | ■ | B | C | 1 | 2 | 3 | FIRST SYMBOL |

SERIAL NO. A A B 3 3 3

SECOND SYMBOL

FIRST SYMBOL

FIG. 2

| | | | | | | | |
|---|---|---|---|---|---|---|---|
| ■ | A | B | C | D | E | F | EIGHTH SYMBOL |
| ■ | A | B | C | D | E | F | SEVENTH SYMBOL |
| 0 | A | B | C | D | ■ | F | SIXTH SYMBOL |
| 0 | A | B | C | D | ■ | F | FIFTH SYMBOL |
| 0 | A | B | C | ■ | E | F | FOURTH SYMBOL |
| 0 | ■ | B | C | D | E | F | THIRD SYMBOL |
| 0 | ■ | B | C | D | E | F | SECOND SYMBOL |
| 0 | ■ | B | C | D | E | F | FIRST SYMBOL |

SERIAL NO. A A A D E E

SECOND SYMBOL

FIRST SYMBOL

FIG. 3

SECURITY DEVICE FOR SHEET MATERIAL AND METHOD OF MARKING THE DEVICE

BACKGROUND OF THE INVENTION

This invention relates to sheet material such as negotiable instruments, currency or other documents having critical numerical data as currency values, serial numbers and the like on the face thereof. Commercial paper in the form of checks, bank drafts and the like represent a large portion of the sheet material to which this invention pertains.

More particularly, the invention relates to a security device imprinted upon sheet material and a method of marking the device to insure the integrity of the paper when processed through automatic scanning or accounting machinery.

PRIOR ART

Prior art devices and methods over which the present invention is an improvement are disclosed and described in U.S. Pat. Nos. 1,543,366, and 2,124,535 issued to Candriana, Patton, Jr. and Bauder, respectively.

The '366 reference shows a system of physically cutting or notching a check to identify several key digits and to show total number of digits represented in the check.

The '535 reference deals with a check legend showing a series of maximum values of a check and a movable cutting template is provided to detach inappropriate portions of the legend.

SUMMARY OF THE INVENTION

A principal feature of the present invention is the provision of a security device which is printable upon sheet material such as a check where the sheet material is processed in high speed scanning or automatic accounting machinery.

A pattern of indicia such as digits, alphabetical or alpha-numeric symbols are arranged in horizontal, vertically spaced rows.

The appropriate digit, letter or other symbol is marked in each row in sequence to correspond to a desired numerical value, currency sum or serial number.

In cases where the pattern is intended to record currency sums as in a check or bank draft, money order or the like, each row includes the Arabic symbols 0 through 9 with the appropriate national currency symbol such as the dollar sign ($) or the French franc symbol (ff), as the case may be.

In U.S. currency the rows are labeled in accordance with the decimal system so that a numerical value can be recorded by marking the appropriate digit in each row.

In cases where alphabetic or alpha-numeric patterns are used to record serial numbers, identification numbers and the like, the rows include letters, Arabic symbols or a combination of both, as desired. The rows are labeled according to the sequence of letters or symbols in the serial or identification number being removed.

A special feature of the digit pattern and the system of marking is that it lends itself to a simple scanning system. That is, the scanning device is set to recognize marks, the significance of marks, their location or the lack of marks. As will be apparent hereinafter, one mark, two marks or no marks in a given row can be significant.

Thus, it is a further feature of the invention to provide a security device marked by the maker of the instrument which precludes another from changing fraudulently the numerical value on the face thereof.

While it is apparent that the main area of utility of the device and method of the present invention falls within the realm of checks, money orders and bank drafts of various national currencies, it is entirely within the scope of the invention to find application in stock certificates, bonds, credit card receipts of all origins and currencies.

A security device employing certain features of the present invention and applicable to sheet material such as negotiable instruments, currency, or other documents having critical numerical data on the face thereof may comprise a numerical pattern defining a plurality of linear, generally parallel rows of digits, each row containing the ten Arabic digits or symbols 0 through 9 in spaced array, said rows being disposed horizontally and spaced vertically for line-by-line scanning and each row being labeled in accordance with multiples of the decimal system.

A method employing certain steps of the invention may comprise imprinting upon sheet material a pattern of digits in horizontal rows where each row contains a currency symbol and the ten Arabic symbols or digits 0 through 9, labeling the rows in sequence according to the multiples of the decimal system, recording a numerical value by marking the appropriate digit in each row, and marking the currency symbol in the highest value row leaving all remaining rows free of marks.

Other features and advantages of the present invention will become more apparent from an examination of the succeeding specification when read in conjunction with the appended drawings, in which:

BRIEF DESCRIPTION OF THE DRAWINGS

The FIG. 1 shows a plan view of sheet material in the format of a check.

FIGS. 2 and 3 show alternative security device patterns.

DESCRIPTION OF THE INVENTION

Figure 1:
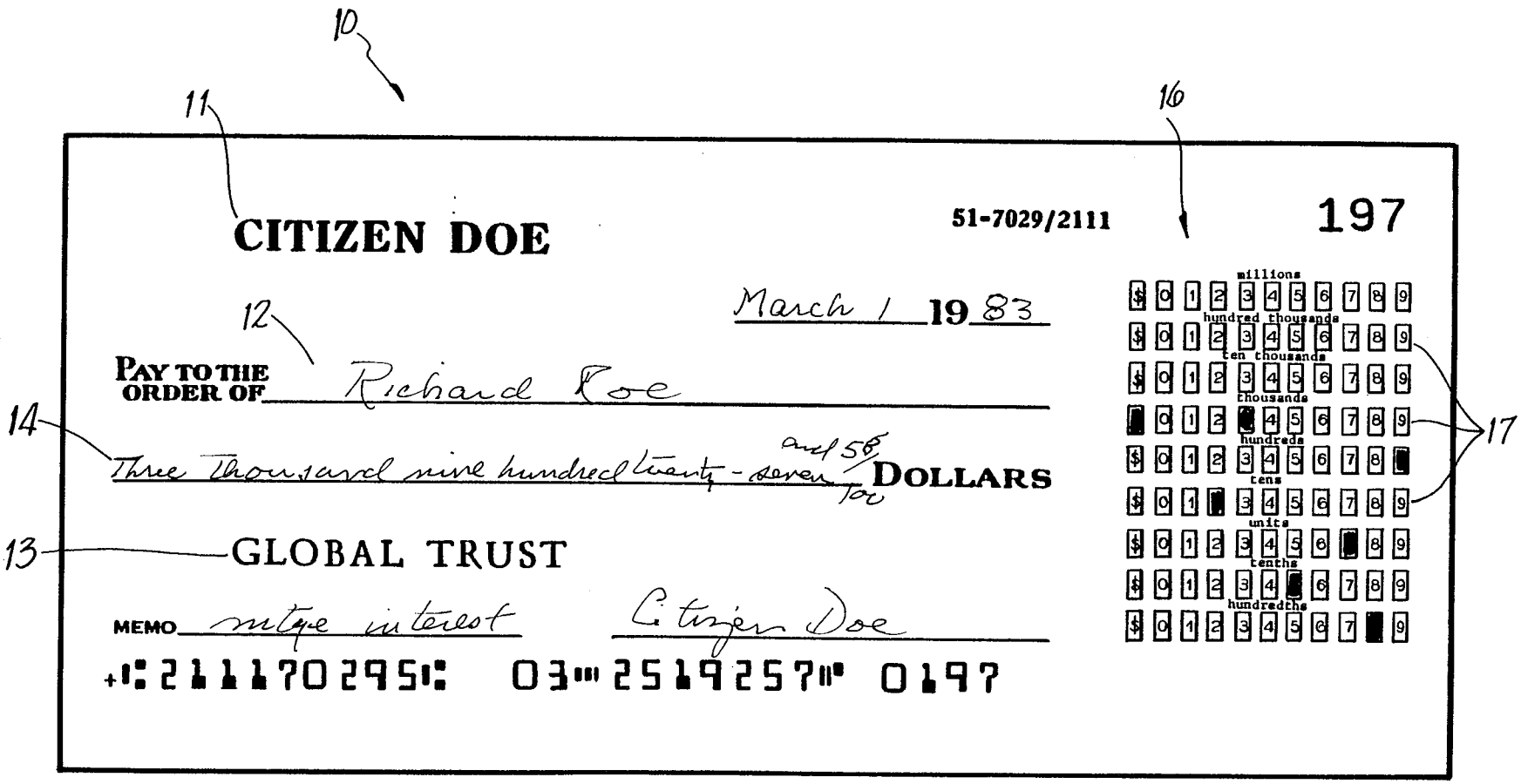

Referring to FIG. 1, the reference numeral 10 designates a conventional check showing the drawer's name at 11, the payee at 12 and the drawee bank at 13.

The reference numeral 14 indicates the usual place for the written or printed sum for which the check is drawn.

Illustrated generally by the reference numeral 16 is the security device imprinted upon the check providing a numerical representation of the sum for which the check is drawn.

The device includes a plurality of rows 17 each containing an array of digits reading from left to right, 0 through 9.

The rows are generally horizontal, parallel to one another and are spaced vertically.

This arrangement facilitates scanning or "reading" the digits in well-known fashion by modern automatic machinery.

The rows of digits are labeled, in this case according to multiples of the decimal system, and the dollar symbol appears at the left end of each row to indicate U.S. currency.

Reading from the bottom of the security device, the first row is labeled "hundredths", the second row "tenths", the third units increasing by multiples of 10 up through millions.

At this point it is well to note that the present invention is not limited to the scale of decimals shown or to currency symbols.

For example, the rows of digits could begin with "thousandths" or "ten thousandths" and range up to billions as particular uses of the security device of the present invention dictate.

In addition, the device may employ alphabetical indicia or a combination of alphabetical symbols and numeric symbols to assign serial numbers to stock certificates or catalog numbers to books or valuable documents, for example.

Operation

The operation of the disclosed embodiment of the security device of the present invention as applied to check 10 is as follows:

Assume that the drawer, Citizen Doe, wishes to draft a check in the amount of $3927.58.

In usual fashion, he enters in longhand (or by typing) on the line ending "DOLLARS" the language "Three thousand nine hundred twenty-seven and 58/100".

Next, Citizen Doe moves to the security device 16 and marks (check-mark, circle, cross-out or other indication) appropriate digits in the various rows to indicate $3927.58 numerically.

Thus, in the first row (hundredths) he marks "8", in the next row (tenths) he marks "5", in the units row "7", the tens row "2", the hundreds row "9", and finally in the thousands row "3".

In addition (and this step is critical to preclude fraud), Citizen Doe marks the dollar symbol ($) in the row of the highest value digit leaving the remaining rows blank.

Thus, the "hundredth" through "hundreds" rows each contain a single mark and the "thousands" row contains two marks and the remaining rows are free of marks. Such marking is recognized by the scanner as valid.

Should a mark be made above the "thousands" row or the maker fail to mark the dollar symbol ($) in the thousands row, the check would be rejected indicating a maker error or an attempt to raise the check fraudulently.

In further description of the operation of the security device, assume that one wished to apply the number "300.00" to a document as an identifying number.

First, the security device 16 must be imprinted upon the document preferably without a currency symbol.

Next, the lines "hundredths" through "tens" are each marked at the digit 0 (zero). Thereafter the digit "3" is marked in the hundreds line and the remaining lines or rows of digits are marked at 0, completing the serial number 300.00.

Note that in this embodiment of the security pattern, each line must contain a mark to prove validity to the scanner.

FIG. 2 shows an alpha-numeric pattern of the security device. The serial number AAB333 is registered by marking "A" in the bottom row, "A" in the second row and succeeding symbols through "3" in the sixth row. Rows 7 and 8 are marked at the zero (0) symbol.

FIG. 3 shows an alphabetic pattern and the indicia AAADEE is registered by marking appropriate symbols in rows 1 through 6 and rows 7 and 8 are marked at the zero (0) symbol.

It is anticipated that a wide variety of modifications may be devised in the security device and the method of marking without departing from the spirit and scope of the invention.

As stated earlier the device is not limited to U.S. or foreign currency but is useful in any numerical, alphabetical or alpha-numerical system for indicating and securing serial numbers of documents.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method of indicating the face value of a commercial document such as a bank draft or a check while simultaneously precluding subsequent alteration thereof comprising the steps of:

providing a conventional check-size sheet of cellulosic material, allotting a portion of said sheet defining a single, generally rectangular field or outline for indicating face value digitally and for precluding subsequent alteration, arranging within said outline a plurality of vertically spaced rows of Arabic digits in which each row contains the digits 0 through 9 including a monetary symbol, labelling each row in accordance with multiples of the decimal system, indicating the face amount of the check by marking a single digit in the appropriate rows of digits, and, precluding subsequent alteration by marking the monetary symbol of the particular row of Arabic digits which includes the most significant digit of said face value.

* * * * *